US009472860B1

(12) United States Patent
Wiser

(10) Patent No.: US 9,472,860 B1
(45) Date of Patent: Oct. 18, 2016

(54) ANTENNA ARRAY AND METHOD FOR FABRICATION OF ANTENNA ARRAY

(75) Inventor: Ann M. Wiser, Lumberton, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 230 days.

(21) Appl. No.: 13/416,568

(22) Filed: Mar. 9, 2012

(51) Int. Cl.
*H01Q 21/06* (2006.01)
*H01Q 1/12* (2006.01)
*H01P 11/00* (2006.01)

(52) U.S. Cl.
CPC ..... *H01Q 21/064* (2013.01); *H01P 11/008* (2013.01); *H01Q 1/12* (2013.01)

(58) Field of Classification Search
CPC ..... H01Q 3/2617; H01Q 21/06
USPC ..... 343/756, 767, 770, 879; 29/600
See application file for complete search history.

(56) References Cited

U.S. PATENT DOCUMENTS 4,959,658 A * 9/1990 Collins ..... H01Q 21/064 343/778
5,281,941 A * 1/1994 Bernstein ..... H01F 5/02 336/188
5,845,391 A * 12/1998 Bellus et al. ..... 29/600
6,276,596 B1 * 8/2001 Gruber et al. ..... 228/225
6,359,596 B1 * 3/2002 Claiborne ..... 343/795
6,891,511 B1 * 5/2005 Angelucci ..... 343/767
7,106,268 B1 * 9/2006 Angelucci ..... 343/797
7,193,578 B1 3/2007 Harris et al.
2005/0174744 A1 * 8/2005 Zheng ..... 361/760
2009/0153426 A1 * 6/2009 Worl et al. ..... 343/776
2009/0288280 A1 * 11/2009 Brendel et al. ..... 29/25.41
2014/0059840 A1 * 3/2014 Thompson et al. ..... 29/600

OTHER PUBLICATIONS

"The ARRL Antenna Book", The American Radio Relay League, 1988 pp. 2-24 to 2-25.*

* cited by examiner

*Primary Examiner* — Sue A Purvis
*Assistant Examiner* — Daniel J Munoz
(74) *Attorney, Agent, or Firm* — Howard IP Law Group, PC

(57) ABSTRACT

A method for fabricating a radar array assembly comprises providing a mounting plate including first mounting holes and second mounting holes, at least some of the second mounting holes being between at least some of the first mounting holes. Grooved posts having longitudinal grooves are installed within the first mounting holes, and panel sections of antenna elements are disposed within the longitudinal grooves of adjacent installed grooved posts. Each of the antenna elements further includes a connector section that is disposed within the second mounting holes.

28 Claims, 8 Drawing Sheets

ANTENNA ARRAY AND METHOD FOR FABRICATION OF ANTENNA ARRAY

STATEMENT OF GOVERNMENT INTEREST

This invention was made with government support under Contract/Grant N00173-09-C-2013 for the U.S. Department of the Navy. The United States Government may have certain rights in this invention.

FIELD OF THE INVENTION

The present invention relates to the field of microwave antenna arrays.

BACKGROUND OF THE INVENTION

As the frequency of operation of radar antennas increases, the spacing between the radiating elements that make up the aperture becomes smaller. For example, the spacing may be less than 1.0 cm (0.400") center-to-center at 16 GHz (Ku band). In addition, effective phased array radars can have 10,000 or more radiating elements. The radiating elements in these millimeter radar assemblies have critical alignment requirements. They require isolation between adjacent radiating elements and excellent grounding. In addition, the radiating elements in millimeter radar assemblies require thermal management due to their high power generation in small effective areas.

Previous processes formed the mechanical attachment between adjacent radiating elements in a phased array aperture with epoxy joints and machined features in soft-substrates such as "Duroid®". Materials such as polytetrafluoroethylene (PTFE) and "Duroid®" (PTFE/glass or PTFE/ceramic composites) exhibit poor dimensional stability, cold flow characteristics, and deformation under cutting stresses. Unlike metals, features machined in these materials cannot be relied upon to provide the positional alignment required in a high/wide band phased array aperture. Therefore to achieve element-to-element alignment and orientation, radiating elements were assembled using complicated tooling that required tedious fabrication procedures.

For example, element-to-element alignment and orientation of individual radiating elements on individual substrates are often performed using a "rake" tool and a joe block. The rake is used to establish a predetermined spacing between cells in the array, and the individual substrates are then positioned around the joe block to establish the correct orientation and location of the substrates. The array is built up by adding individual radiating elements. In the case of stripline circuit elements assembled in this manner, plated through-holes (vias) were used for isolation between adjacent radiating elements. This type of assembly can also have spurious grounds due to uneven or decaying epoxy joints.

Another previous process used screws to fasten radiating elements to a substrate. However, because the size between the antenna elements of millimeter antennas is so small, a screwed-in approach will not work because even the smallest screws are too large for use in a millimeter antenna array.

An improved array structure and method of making millimeter antenna array is desired.

SUMMARY OF THE INVENTION

An improved radar array assembly, radar array assembly posts, and method for fabricating a radar array assembly are disclosed. The method and apparatus provide a strong thermal heat path, a transfer of tight tolerances from the duroid antenna panels to the metal posts of the radar array assembly, and includes a simplified design that is repeatable and scalable to other Vivaldi antenna designs at other frequencies. The metal posts provide a strong thermal heat path from the antenna elements to the mounting (face) plate and allow for a design that does not require selective tin-lead soldering of adjacent duroid elements, which makes the array easier to produce. The metal posts may be easily customized for different width antenna elements and the metal posts can be easily altered for varying lattice spacing. The metal posts also become self-aligned as antenna elements are installed within the grooves of the posts. Element height differences in the posts and panels may be accounted for in the fabrication process using a simple heavy plate and gasket configuration. The mounting plate holes may easily be altered for different size antenna elements and mounting posts.

A method for fabricating a radar array assembly is disclosed, comprising the steps of (a) providing a mounting plate including first mounting holes and second mounting holes, at least some of the second mounting holes being between at least some of the first mounting holes; (b) installing grooved posts having longitudinal grooves within the first mounting holes; and (c) disposing panel sections of antenna elements within the longitudinal grooves of adjacent installed grooved posts, each of the antenna elements further including a connector section that is disposed within the second mounting holes. The first and second mounting holes may be counterbored. The longitudinal grooves are within a first section of the grooved posts, the grooved posts may further comprise a shaft section, and installing the grooved posts in the first mounting holes may further comprise installing the shaft section of each of the grooved posts in the first mounting holes. The method may further comprise rotating the grooved posts so that the grooves of adjacent grooved posts are aligned to receive one of the panel sections of one of the antenna elements. The method may also further comprise pre-tinning portions of the mounting plate and the grooved posts with a metal.

The method for fabricating a radar array assembly may also comprise heating the radar array assembly to reflow the metal, thereby forming first conductive joints between the grooved posts and the first mounting holes, second conductive joints between the antenna elements connector sections and the second mounting holes, and third conductive joints between the grooved posts and the panel sections of the antenna elements. The method may further comprise, before heating the radar array assembly, providing additional solder to the radar array assembly for reflow on the first conductive joints, the second conductive joints, or the third conductive joints. The method may also further comprise, before heating the radar array assembly to reflow the metal, disposing a heavy metal plate on top of the grooved posts and the antenna elements, thereby applying pressure to the top of each of the grooved posts and the antenna elements to ensure proper seating of each of the grooved posts and the antenna elements. The heavy metal plate may include heavy plate holes coincident with a top of each of the grooved posts, the heavy plate holes containing solder that flows down onto the top of each of the grooved posts during heating of the radar array assembly. The method may also further comprise, after heating the radar array assembly, applying additional solder to the grooved posts to supplement the first conductive joints, the second conductive joints, and the third conductive joints.

A method for fabricating a millimeter radar array assembly may comprise the steps of: (a) providing a mounting plate; (b) drilling staggered first cylindrical mounting holes and second cylindrical mounting holes in the mounting plate; (c) disposing posts having longitudinal grooves within the first cylindrical mounting holes; and (d) installing antenna elements between adjacent posts by disposing panel sections of the antenna elements within the longitudinal grooves of the adjacent installed posts and disposing cylindrical antenna base sections of the antenna elements within the second cylindrical mounting holes. The posts may further comprise a cylindrical post base section, and disposing the posts in the first cylindrical mounting holes may comprise disposing the cylindrical post base section of each of the posts in the first cylindrical mounting holes. The method may further comprise rotating the posts so that the longitudinal grooves of adjacent posts are aligned to receive one of the panel sections of one of the antenna elements. The method may also further comprise pre-tinning portions of the mounting plate and the posts with a metal.

The method for fabricating a millimeter radar array assembly may comprise heating the radar array assembly to reflow the metal, thereby forming first conductive joints between the posts and the first mounting holes, second conductive joints between the cylindrical antenna base sections and the second cylindrical mounting holes, and third conductive joints between the posts and the panel sections of the antenna elements. The method may further comprise, before heating the radar array assembly, providing additional solder to the radar array assembly for reflow on the first conductive joints, the second conductive joints, or the third conductive joints. The method may also further comprise, before heating the radar array assembly to reflow the metal, disposing a heavy metal plate on top of the posts and on top of the antenna elements, thereby applying pressure to the top of each of the posts and to the top of each of the antenna elements to ensure proper seating of each of the posts and antenna elements. The heavy metal plate may include heavy plate holes coincident with a top of each of the posts, the heavy plate holes containing solder that flows down onto the top of each of the posts during heating of the radar array assembly. The method may also further comprise, after heating the radar array assembly, applying additional solder to the posts to supplement the first conductive joints, the second conductive joints, or the third conductive joints.

A radar array assembly may comprise: a mounting plate including first mounting holes and second mounting holes, at least some of the second mounting holes being between the first mounting holes; grooved posts comprising a first section having a generally square cross-section and longitudinal grooves on each side and a shaft section, the shaft section of each of the grooved posts being affixed within the first mounting holes; antenna elements having a panel section and a cylindrical connector base, the panel section of each of the antenna elements being affixed within the grooves of adjacent installed grooved posts and the cylindrical connector base of each of the antenna elements being affixed within the second mounting holes. The mounting plate may comprise a gold plated copper plate with tin-lead plating on areas between the first mounting holes and the second mounting holes. The grooved posts may comprise tin-lead plating over gold over beryllium copper. Each of the panel sections may comprise a dielectric board defining a conductive horn and a stripline feed structure, said stripline feed structure being electrically connected to the conductive horn and the cylindrical connector base of each of the panel sections. The grooved posts may be affixed within the first mounting holes with a metal, the edge of the antenna elements may be affixed to the grooves with a metal, and the cylindrical connector bases may be affixed within the second mounting holes with a metal. The metal may be one of a group consisting of solder and iridium.

A mounting post for a millimeter antenna array comprises: an upper section having lengthwise grooves sized to accept an edge of an antenna element panel; and a lower shaft section adjacent to the upper section and sized to closely fit within a mounting plate hole. The upper section may have four sides and a lengthwise groove centered on each of the four sides. The lower shaft section may be cylindrical and the mounting post may be comprised of tin-lead plating over gold over beryllium copper.

DETAILED DESCRIPTION

Figure 1:
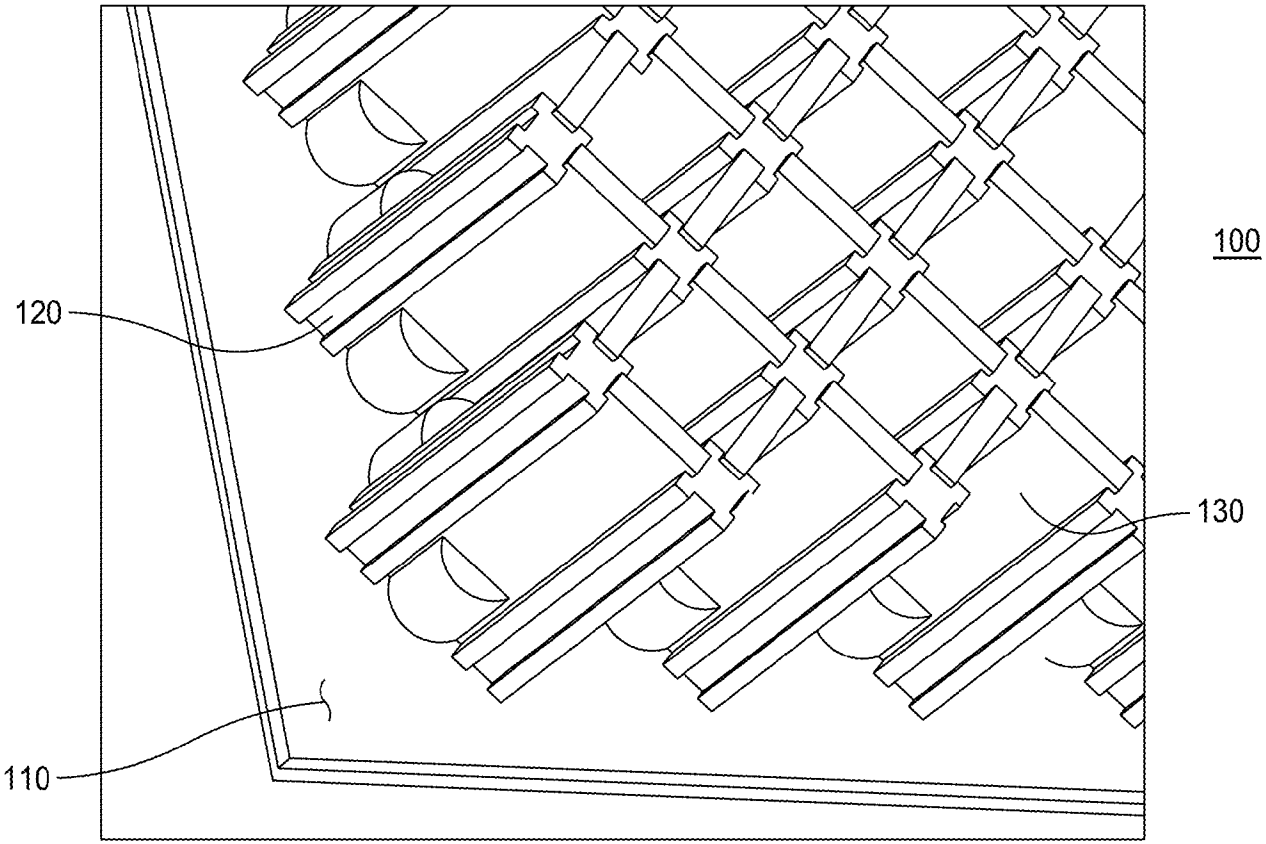
FIG. 1 is an isometric view of an exemplary microwave antenna array 100.

In the accompanying drawings, like items are indicated by like reference numerals.

This description of the preferred embodiments is intended to be read in connection with the accompanying drawings, which are to be considered part of the entire written description of this invention. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

FIG. 1 is an isometric view of an exemplary microwave antenna array assembly 100. Array 100 may be a complete aperture or a fractional portion of a larger array suitable for use in a wide-band phased array radar system. In the exemplary array 100, radiating antenna elements are assembled above a metal ground between grooved posts. Specifically, the fractional radar array assembly, 100 comprises a ground plane 110, a plurality of grooved posts 120 inserted into the ground plane 110, and a plurality of antenna half-elements 130 between the grooved posts 120. (As will be understood, in an embodiment a "full" antenna element is comprised of two of the antenna half-elements 130. As used herein, the term "antenna element" may refer to a single-half element or a plurality of half-elements.) The ground plane 110 may be a plate of suitable metal, such as aluminum or copper. The antenna elements may be a substrate with a radiating element and an electrical connector. The ground plane 110 of exemplary array assembly 100 includes cylindrical holes for mounting the grooved posts 120 and the antenna elements 130. The cylindrical holes permit easy alignment and adjustment of the grooved posts 130, enabling easy installation of the antenna elements 130 within the grooves of the grooved posts 130.

Figure 2B:
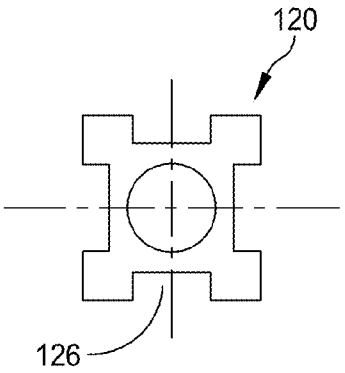
FIG. 2B is a top view of one of the grooved posts shown in FIG. 1.
Figure 2A:
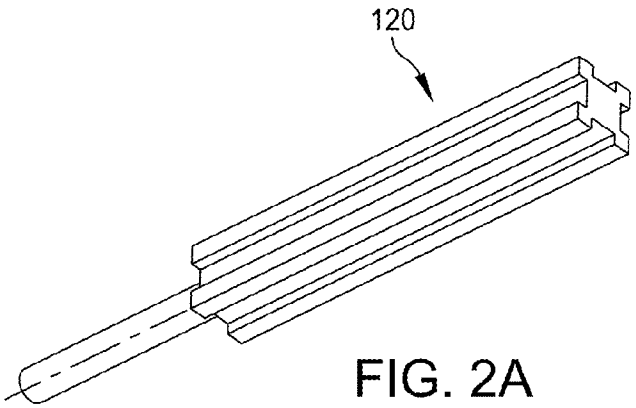
FIG. 2A is an isometric view of one of the grooved posts shown in FIG. 1.
Figure 2C:
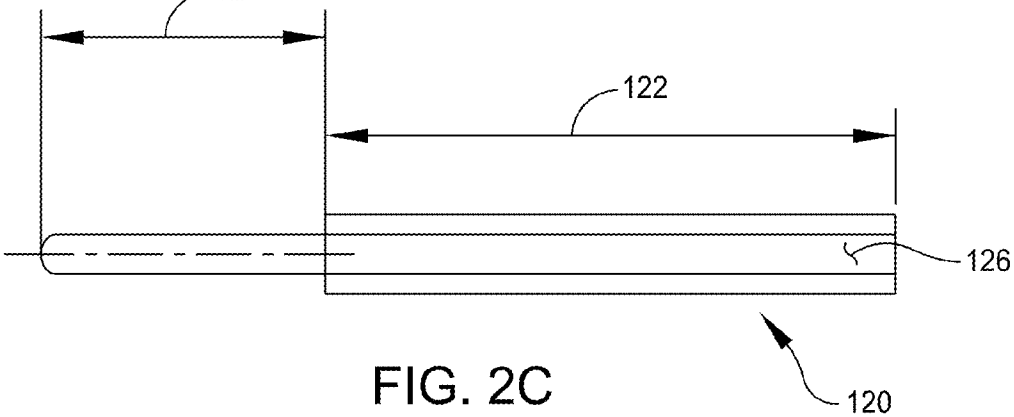
FIG. 2C is a side elevation view of one of the grooved posts of FIG. 1.

FIGS. 2A-2C show an exemplary grooved post 120 that may be used in the assembly 100 for assembling a lattice of antenna elements. FIG. 2A shows an isometric view of a grooved post 120, FIG. 2B shows a top view of the grooved post 120, and FIG. 2C shows a side view of the grooved post 120. In an embodiment, the grooved post 120 has a first section with a generally square cross-section 122 and a shaft section 124. The first section 122 has longitudinal grooves 126 centered on each of the four sides of the generally square cross-section 122, and the grooves are sized to enable an antenna element to be captured within the groove. The groove depth and width are selected to closely receive the edge of a panel section of an antenna element within the groove, yet at the same time are sized to enable installation of the edge of the panel section without the need for undue force. As will be understood, the grooved post dimensions (e.g., the overall size and size of the grooves) may be customized for different sized antenna elements. As will also be understood, the first section 122 may alternatively have a different shape other than square, as long as the shape is able to accommodate longitudinal grooves at 90 degrees from each other. For example, a grooved post with a generally cylindrical section with grooves at 90 degrees from each other could be used.

The shaft section 124 is shaped to be orthogonally inserted into a cylindrical mounting hole in the ground plane 110 and has a diameter that enables the shaft to have a close fit into the mounting hole. As noted, the grooved post 120 should be rotatable to align the grooves 126 of adjacent posts so that the panel section of an antenna element 120 may be installed into the grooves, so the fit of the shaft section 124 in the mounting hole should permit this rotation.

In some embodiments, the grooved post may be made of a single piece of metal formed on a machine such as a CNC machine or wire/plunge EDM. The grooved post 120 may be solid (i.e., not hollow), which prevents microwaves from jumping across between adjacent radiating elements. In other embodiments the grooved post may be made of separate pieces such as a separate first section and shaft, and in other embodiments the shaft section may be hollow. In addition, in some embodiments the shaft may be tapered. A tapered shaft is advantageous in that it makes the grooved post self-centering within the mounting hole in the ground plane, even if there is an imperfection in the mounting hole into which the shaft fits. The taper is not required, and the shaft may be cylindrical in other embodiments. In either embodiment, the cylindrical shape (whether tapered or not) allows the grooved post to be rotated within the cylindrical mounting hole in the ground plane. As will be understood, the grooved posts may be rotated so that the grooves of adjacent grooved posts are aligned to receive the panel section of an antenna element. As will also be understood, once a grooved post has been rotated so that one groove is aligned with the groove of an adjacent grooved post, that grooved posts is also aligned for any antenna elements that may be installed within the other 3 grooves of that grooved posts. Thus, alignment of an individual grooved post is only required once.

In an embodiment, the grooves 126 have flat side walls. This allows a solder or conductive adhesive joint to run the full length of the side walls. Alternatively, it is possible for the side surface of the grooves to be sloped downward, in which case the panels of the antenna to be installed within the grooves may be tapered so that the edges (or ends) of the panel pair with the grooves. It is also possible for the side surface of the grooves to have features (e.g., ridges, grooves, pits or the like, not shown), so that the contact surface between the grooved post 120 and the antenna elements is not a completely flat surface.

The grooved post 120 may be made from of a solderable material (e.g., copper or a chromium-copper alloy), or the grooved post 120 may be tin-plated with a metal such as solder or an iridium plating. The grooved post in this example is made of tin-lead plating over gold over copper-beryllium for strength, which further enables each grooved post to act as a heat path to transfer heat from the antenna elements to the mounting plate. The copper-beryllium embodiment adds beryllium to copper for strength to prevent bending of the posts. Solder plating on all surfaces provides solder volume and protects the grooved post from the environment. When the grooved posts 120 and antenna elements 130 are assembled, the solder can be reflowed to form secure physical and electrical connections among the grooved posts and antenna elements. As will be understood, the edges or ends of the antenna elements are in electrical (and physical) connection with the grooves in which they are installed. The solder may be tin-lead solder, or other solder compositions or iridium may be used. In alternative embodiments, conductive adhesive (e.g., conductive epoxy) may be used to form secure physical and electrical connections among the grooved posts and antenna elements. In still other embodiments, solder can be applied in situ after assembly of the grooved posts 120 and antenna elements onto the ground plane. The grooved post 120 is advantageous when used in a reflow process and provides the junction for a solder joint between radiating elements. It provides a well-defined mechanical attachment to the groundplane, and hence each grooved post 120 forms a structural node in the assembly. It provides excellent element-to-element isolation and grounding. The grooved post design also allows for the use of close tolerances on the posts, which is important because it is not currently possible to use tolerances that are as close in the cutting of the duroid elements. The exemplary grooved post forms a reliable mechanical solder attachment for orthogonally placed soft-substrate radiating elements in wide-band phased array radar apertures.

FIGS. 3A-3D show an exemplary antenna element 130 that may be used in array 100. Antenna element 130 includes a round base connector section 136 and a panel section 132. The panel section 132 may be made from a substrate of "duroid" PTFE ceramic composition, manufactured by the Rogers Corporation of Rogers, Conn. The substrate may have two 0.63 mm (0.025") layers of PTFE ceramic dielectric. One of the layers has a central stripline copper trace 144 (a stripline feed structure), which electrically couples a radiating element (horn) 134 to a pin that is also installed on the panel. The pin is then electrically and physically connected to connector 136. The two layers of substrate may be fusion bonded. Each outer face of the substrate may have a 1.27 mm (0.05") copper ground layer. The exemplary grooved post 120 may have a tin-lead plating (Sn63-Pb37) to provide the solder volume required to form a joint between the groove 126 of the grooved post 120 and an edge (or end) of the panel section 132 of the antenna element in a reflow operation and protect the joint from the environment. The antenna element may also include a solder mask (element 137 in FIG. 3A) around the perimeter of the panel section 132. As will be understood, the solder mask will prevent solder that reflows from flowing to the radiating element horn section 134 of the antenna panel. This exemplary substrate material is only an example. One of ordinary skill can readily select an appropriate dielectric substrate material for any particular application.

Figure 3B:
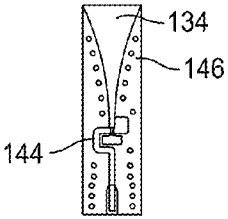
FIG. 3B is an elevation view of one of the antenna elements shown in FIG. 1.
Figure 3D:
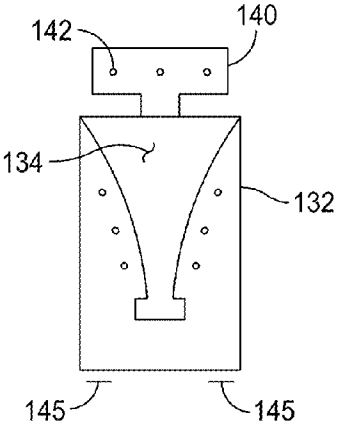
FIG. 3D is an elevation view of an antenna element shown in FIG. 1 with a mounting tab.
Figure 3A:
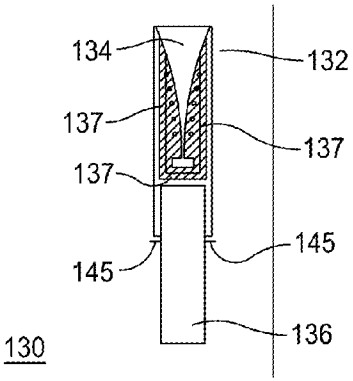
FIG. 3A is an elevation view of one of the antenna elements shown in FIG. 1.

As shown in FIGS. 3A and 3B, the panel section 132 of the antenna element 130 has a radiating element 134 (a conductive horn). The horn 134 can be formed in the substrate by any suitable circuit fabrication process, such as etching or machining the metal ground layers. Each radiating element horn 134 has a connector 136 for connecting the element to the transmit/receive distribution network (not shown). An exemplary connector is a Gilbert G3PO or G4PO male connector manufactured by the Corning Gilbert Corporation of Glendale, Ariz., which can be used to connect the center stripline circuit 144 (between the two layers of substrate) directly to a coaxial cable. A resonating cavity and/or filter may be coupled between the connector 136 and the radiating element horn 134. Each radiating element 130 has a plurality of plated through holes for matching. Additional plated through holes 146 along the edge of the horn 134 form the sides of the horn, and are appropriately spaced for the frequency band of interest. Exemplary through holes may be 0.5 mm (0.02") in diameter. One of ordinary skill can select the size and spacing of the plated through holes for the operating frequency to be used. This exemplary antenna element is only an example. One of ordinary skill can readily select an appropriate antenna element for a particular application.

Figure 3C:
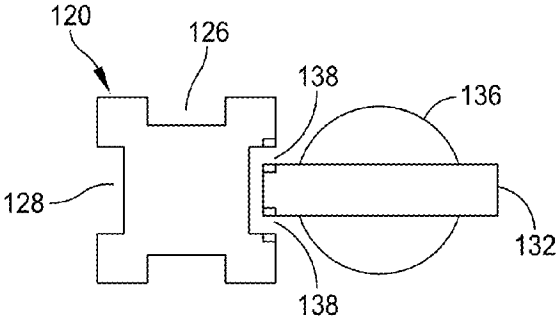
FIG. 3C is a half-element and grooved post interconnection shown in FIG. 1.

The thickness of panel section 132 is coordinated with the width of longitudinal grooves 126 of the grooved posts 120 to enable the panel section to fit within the groove 126. As noted, a close fit between the groove 126 and panel section 132 is desirable, and a fit that requires excessive force to install the panel section with the grooves is not desirable. As shown in FIG. 3C, areas 138 on panel section 132 are in physical contact with groove 126 when the panel section is installed. Areas 138 also provide an electrical connection between the panel section 132 and the adjacent grooved post 120. As will be understood, a close fit between the panel 132 and the groove 126 within which the panel sits will achieve a better electrical connection, although a fit that makes it difficult to install the panel is not desirable. As will also be understood, if the groove 126 is deeper, areas 138 will be wider if the panel 132 is sized to account for the depth, thus providing a better electrical connection. Also, a deeper groove may allow for larger tolerances in the cutting of the panel sections, which is desirable because under currently technology the tolerances in the cutting of the panel sections are not as small as the tolerances used for the posts. In an embodiment, the panel width is selected so that the panel fits closely within groove 126 without contacting face 128 of the groove. Such sizing will allow for tolerances that encompass panels that are slightly larger than specified. Areas 145 on panel section 132 represent the bottom edge of the panel section. When panel section 132 is installed between adjacent grooved posts 120 within antenna element holes 114, areas 145 make contact with the ground plane 110 and become adhered to the ground plane during the reflow process.

In an embodiment, the panel section 132 of the antenna elements 130 may have be formed with a break-off "mounting tab" 140 on the top of each panel as shown in FIG. 3D. The mounting tab 140 is used to position the antenna element within the grooves of adjacent grooved posts, and the mounting tab is formed using known methods so that it can be easily snapped off the top of the antenna elements after positioning is complete. As will be understood, the mounting tabs may have tooling holes 142 as needed by the particular manufacturing equipment being used.

The diameter of connector 136 shown in FIGS. 3A-3D is coordinated with the size of the cylindrical mounting holes in the ground plane 110. The connector 136 is shaped to be orthogonally inserted into a mounting hole in the ground plane 110 and has a diameter that enables the connector to have a close fit into the mounting hole. In an embodiment, the connector 136 may be tapered so that it easily fits into the mounting hole even if there is an imperfection in the mounting hole.

Figure 4:
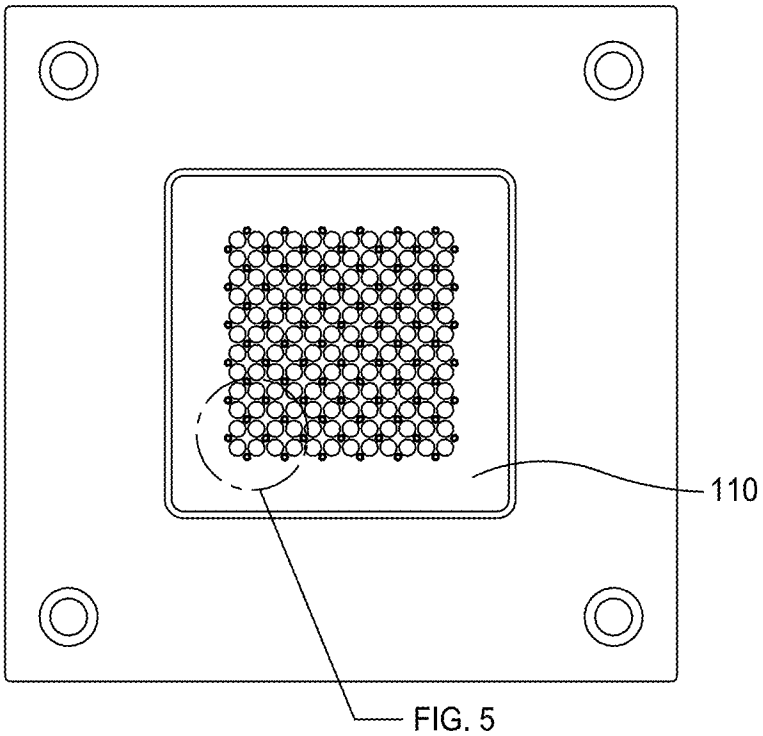
FIG. 4 is a top view of the mounting plate shown in FIG. 1.
Figure 5:
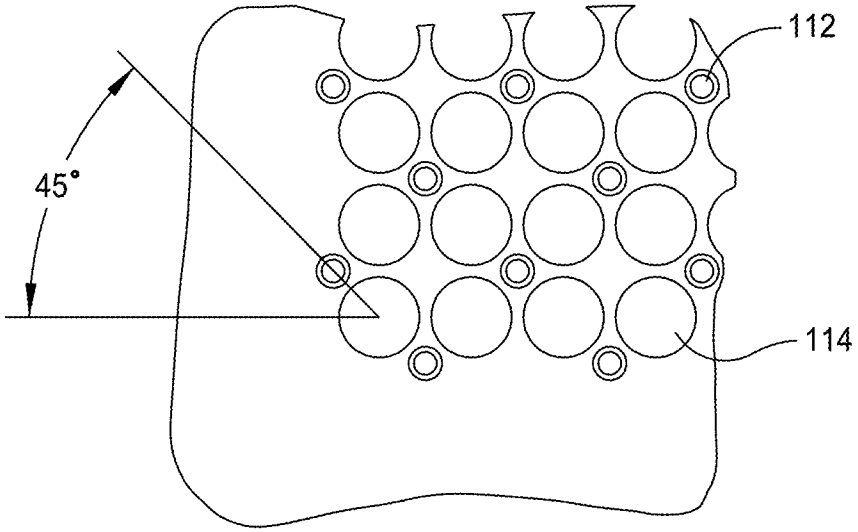
FIG. 5 is a detail of the top view of the mounting plate of FIG. 4.

FIG. 4 shows a top view of the mounting plate 110 for the array. Mounting plate includes a center area with cylindrical mounting holes for the grooved posts 120 and the antenna elements 130. As shown in FIG. 5, in an embodiment grooved post mounting holes 112 and antenna element holes 114 are staggered on the mounting plate and arranged so that there are grooved post mounting holes adjacent to antenna element holes. This arrangement allows for grooved posts to be installed, which is then followed by installation of antenna elements between the grooved posts. As will be understood and as shown in FIG. 5, grooved posts mounting holes do not have to be made between every four antenna element mounting holes. As will also be understood, the mounting holes can be a shape other than cylindrical. For example, the mounting holes can have a square cross-section, which, if the shaft section of the grooved posts (and/or the connector portion of the antenna elements) also have a square cross-section (which may be desirable for stability) sized to provide a close fit with the square mounting hole, will cause the grooved posts to be at a proper orientation when they are installed (provided the relation between the grooves and the square shaft is properly determined). While this "automatic" orientation may be desirable, the cost of creating square mounting holes and square shafts for the grooved posts via wire EDM or other processes are currently not cost effective relative to using cylindrical holes, shafts, and connectors, and then rotating the cylindrical grooved posts to obtain proper orientation as needed.

The mounting plate 110 should be electrically conductive so it may be made from metal such as copper. The copper or other metal may also be gold or nickel plated so the tin-lead solder has a surface to adhere to and creates a non-corrosive barrier. The areas of the mounting plate 110 between the grooved post mounting holes 112 and antenna element mounting holes 114 may be tin-lead plated with a metal, and then a flowing process may be used that will cause the adjacent tin-lead solder to flow down into the holes to affix the grooved posts and antenna elements to the mounting plate. That is, in an embodiment there is no tin-lead solder in the holes themselves, just in the areas adjacent to the holes, and during the reflow process tin-solder may wick down into the mounting holes and adhere the antenna connectors or posts to the mounting holes. As shown in FIGS. 4 and 5, the antenna element mounting holes are larger in diameter than the grooved post mounting holes because the antenna element mounting holes accommodate a connector 136 that includes electrical connections. Of course, an alternative embodiment in which the connector 136 is smaller in diameter may be possible, and the holes in the mounting plate will be drilled accordingly. In an embodiment, either or both the post and antenna element mounting holes may be counterbored. The counterboring better allows the solder to wick down into the mounting holes, and may help guide reflowed solder to enter the holes rather than spread out on the mounting plate. In addition, as will be understood, the spacing of the grooved post mounting holes and antenna element mounting holes can be customized to accommodate different width antenna panels and to vary lattice spacing. Thus, the mounting plate, grooved post, and antenna element design is simple, scalable, and flexible.

Figure 6:
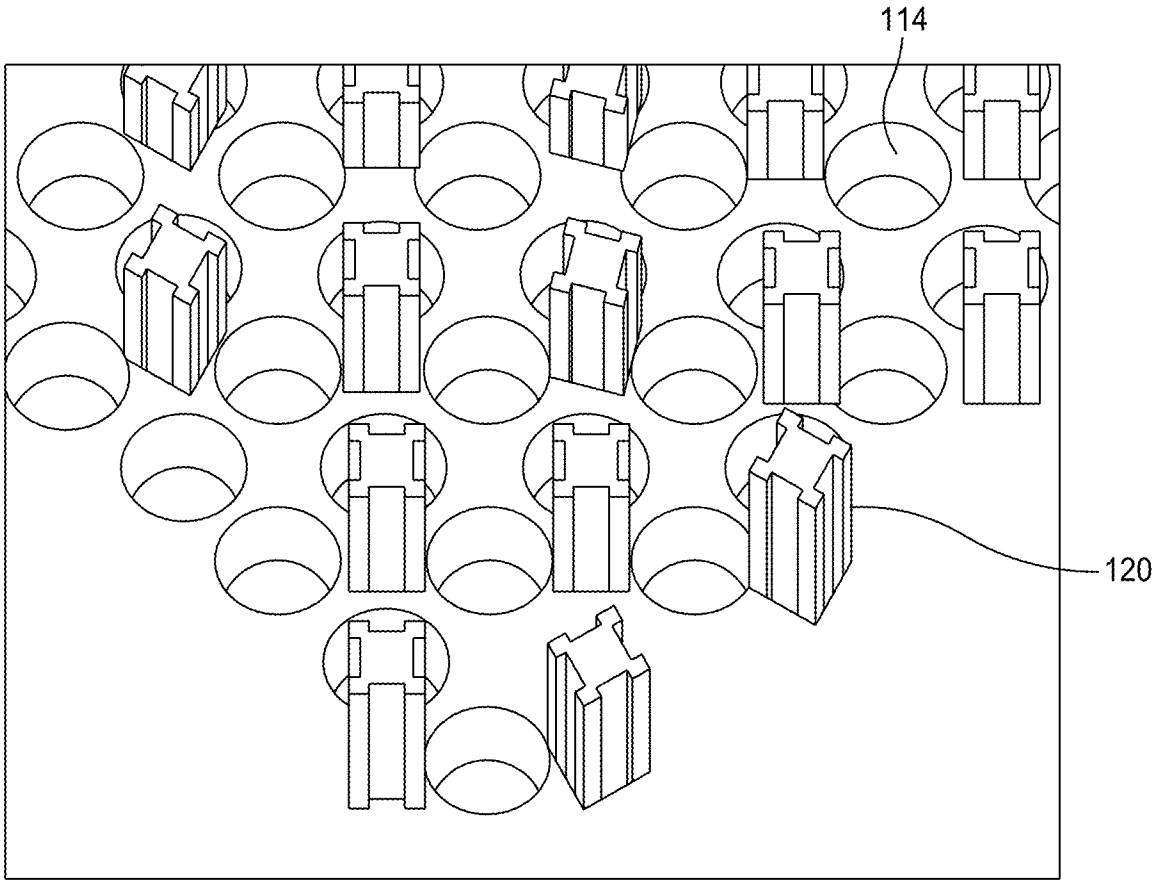
FIG. 6 is a detailed isometric view of the mounting plate with grooved posts shown in FIG. 1.

FIG. 6 shows an isometric view of a center area of the mounting plate in which grooved posts 120 are installed within the grooved post mounting holes. As noted, the grooved post mounting holes are staggered in relation to the antenna element mounting holes. The grooved posts are rotatable so that they may be aligned to allow the installation of antenna elements within the grooves of adjacent grooved posts.

Figure 7:
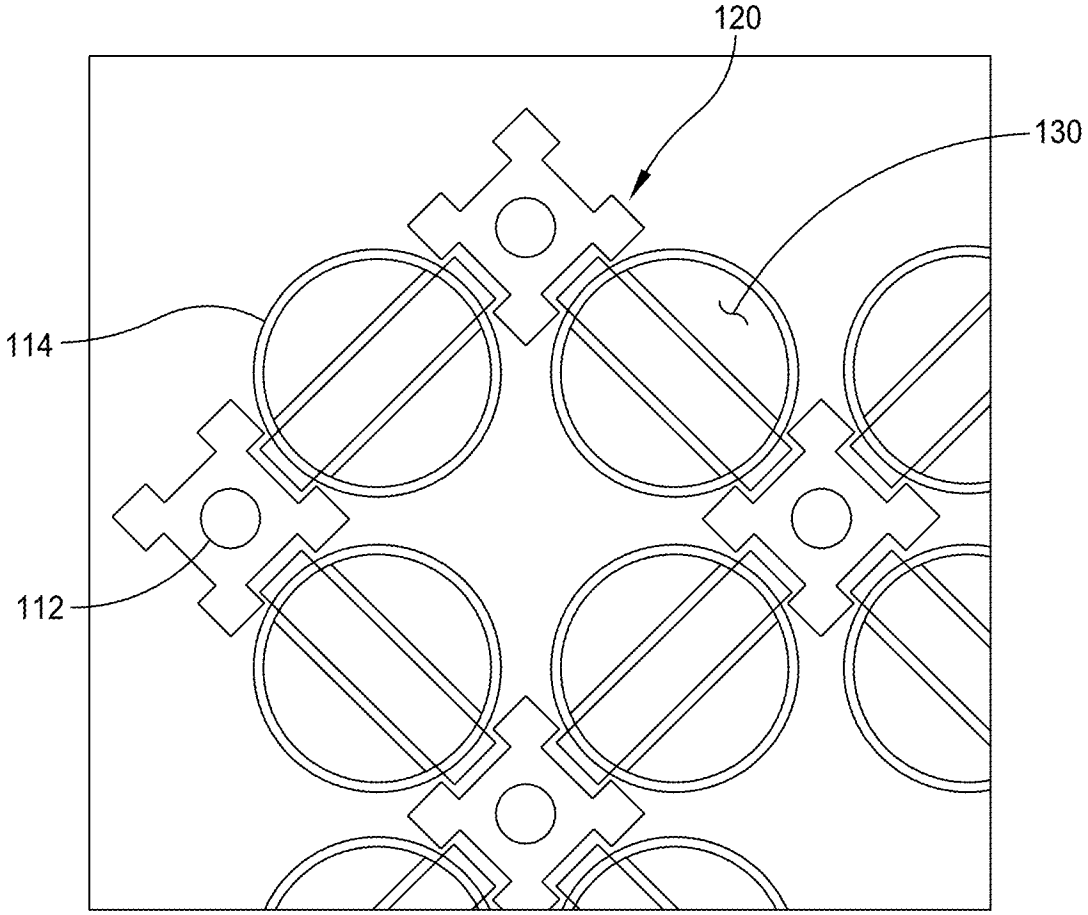
FIG. 7 is a top view of a portion of an exemplary microwave antenna array.

FIG. 7 shows a partial plan view of an assembled section of the center area of the mounting plate. Grooved posts 120 are installed within grooved post mounting holes 112. Antenna elements 130 are installed within the grooves of adjacent grooved posts, and the connector base of the antenna elements are installed within the antenna element mounting holes 114. As will be understood, each grooved post may have two, three, or four antenna elements intersecting at a single grooved post. The grooved post design permits the entire array or a fractional portion thereof to be preassembled and soldered in one mass reflow process.

The radar array aperture disclosed in FIGS. 1-8 may be fabricated by: (a) providing a mounting plate including grooved post (first) mounting holes and antenna element connector (second) mounting holes, at least some of the connector mounting holes being between the grooved post mounting holes; (b) installing grooved posts within the grooved post mounting holes; and (c) sliding panel sections of antenna elements within the grooves of adjacent installed grooved posts, each of the antenna elements further including a connector section that is disposed within the connector mounting holes.

The fabrication method may also comprise pre-tinning the areas between the grooved post mounting holes and the antenna element connector mounting holes of the mounting plate and the grooved posts before the grooved posts and antenna elements are installed within the mounting plate. The metal may be one of the group consisting of solder and iridium. And then after the grooved posts and antenna elements are installed, the entire assembly may be heated to reflow the metal, thereby forming conductive joints between the grooved posts and the grooved post mounting holes and between the antenna element connector and the connector mounting holes, and also thereby forming conductive joints between the grooved posts and the edges or ends or the panel sections of the antenna elements.

Figure 8:
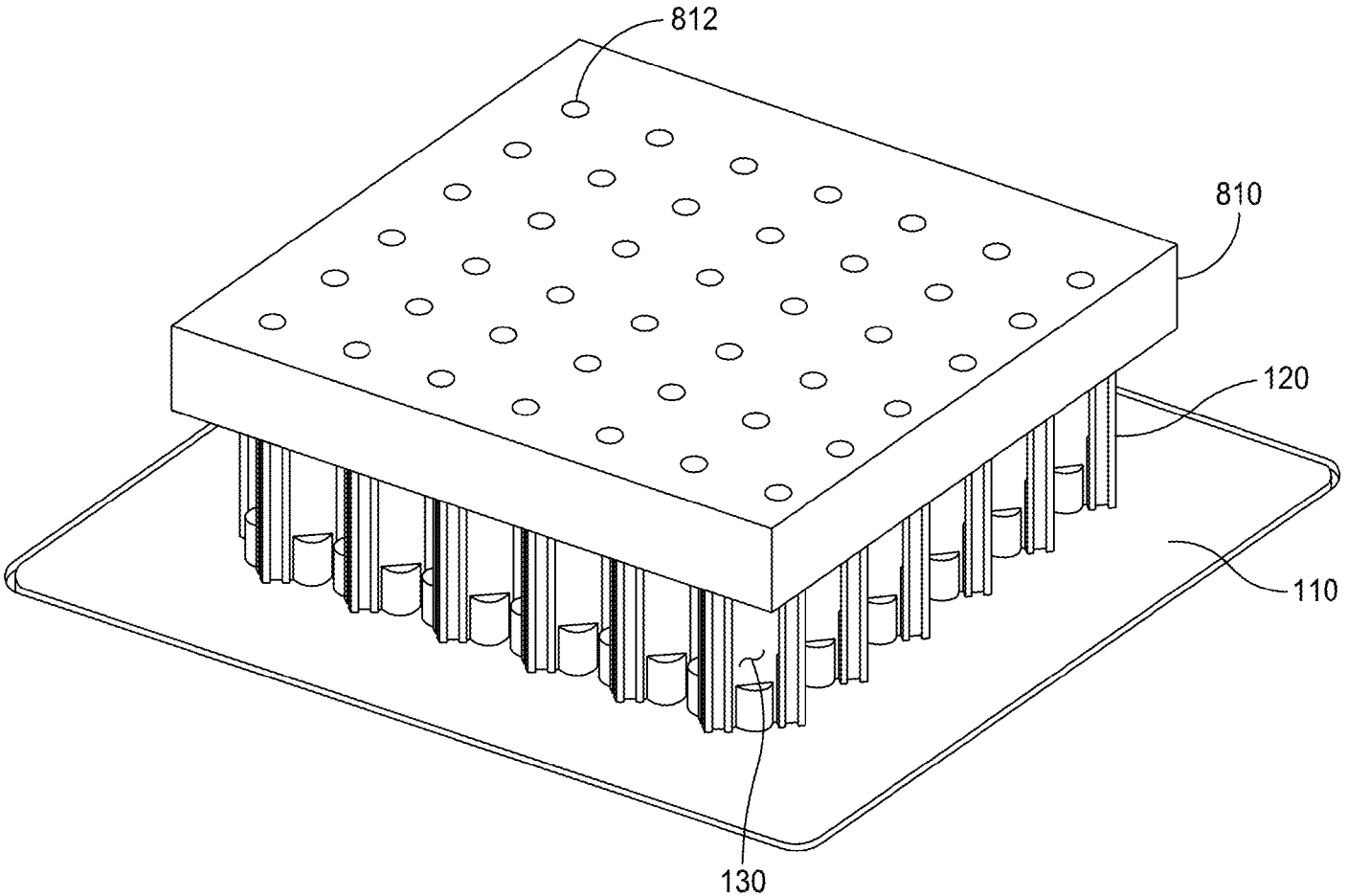
FIG. 8 is an isometric view of the antenna array assembly with a metal plate used during fabrication.

In an embodiment, a heavy metal plate 810 with may be placed upon the installed grooved posts and antenna elements before reflowing as shown in FIG. 8. The plate 810 will apply pressure to the tops of the grooved posts so that they are firmly installed in the grooved post mounting holes. The plate 810 may also apply pressure to the tops of the antenna elements so that they are firmly installed in the antenna element mounting holes. A silicon layer (not shown) may be placed between the plate and the tops of the grooved posts to ensure that the plate applies pressure to the top of each of the grooved posts and the top of the antenna elements when undesirable uneven element heights are observed. In another embodiment, the heavy metal plate may have holes 812 containing solder, the holes being spaced to coincide with the tops of the grooved posts. Then when the entire assembly is heated, the solder in the holes 812 will flow down and provide additional solder onto the grooved posts, which will help to ensure a good connection between the grooved posts and the antenna elements and the grooved posts and the mounting plate. In this embodiment a silicon layer may be used to ensure that the plate applies pressure to the top of each of the grooved posts and/or the tops of the antenna elements. As will be understood, if a silicon layer is used it will have holes that coincide with the holes in the plate so that the silicon doesn't block the solder from flowing from the holes in the plate to the grooved posts. Other known methods of supplementing the solder available for reflow on the grooved posts (e.g., placing additional solder within pockets or cut-outs in the grooved posts) may also be used.

The grooves on the grooved posts may run lengthwise (longitudinally) within a first section of the grooved posts that have a generally square cross-section. In addition, the grooved posts may further comprise a shaft section, and installing the grooved posts in the first mounting holes further comprises installing the shaft section of each of the grooved posts in the first mounting holes. Installing the shaft section of each of the grooved posts may also comprise rotating the grooved posts so that the grooves of adjacent grooved posts are aligned to receive the panel section of an antenna element.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method for fabricating a millimeter wave radar array assembly, comprising the steps of:

(a) providing a ground plane mounting plate including first mounting holes spaced for receiving grooved posts for holding discrete antenna elements and second mounting holes spaced for receiving connector sections of the discrete antenna elements, wherein the center-to-center spacing between the first mounting holes is less than 1.0 cm;

(b) installing a plurality of grooved posts, each grooved post including a body portion having longitudinal grooves, and an elongate shaft portion extending from a lower end of the body portion, onto the ground plane mounting plate by inserting a closed end of the shaft portion of each grooved post into a corresponding one of the first mounting holes so that the lower end of the body portion is disposed on the ground plane mounting plate, wherein the elongate shaft portion has a smaller cross-section than the body portion of the grooved post and wherein the elongate shaft portion is sized to closely fit within the first mounting holes without use of a fastener; and (c) installing a plurality of the discrete antenna elements, each discrete antenna element being physically separate from each other discrete antenna element and including a single panel section having a single radiating horn element and a single connector section electrically coupled to the single radiating horn element, by disposing the single panel section of each discrete antenna element within the longitudinal grooves of adjacent installed grooved posts, and disposing the single connector section of the discrete antenna element within one of the second mounting holes.

2. The method of claim 1, wherein the first mounting holes and the second mounting holes are counterbored.

3. The method of claim 1, further comprising rotating the grooved posts so that the grooves of adjacent grooved posts are aligned to receive one of the panel sections of one of the antenna elements.

4. The method of claim 1, further comprising pre-tinning portions of the ground plane mounting plate, and the grooved posts with a metal.

5. The method of claim 4, further comprising heating the radar array assembly to reflow the metal, thereby forming first conductive joints between the grooved posts and the first mounting holes, second conductive joints between each antenna elements connector section and the second mounting holes, and third conductive joints between the grooved posts and ends of the panel sections of the antenna elements.

6. The method of claim 5, further comprising, before heating the radar array assembly, providing additional solder to the radar array assembly for reflow on the first conductive joints, the second conductive joints, or the third conductive joints.

7. The method of claim 5, further comprising, before heating the radar array assembly to reflow the metal, disposing a heavy metal plate on top of the grooved posts and the antenna elements, thereby applying pressure to the top of each of the grooved posts and the antenna elements to ensure proper seating of each of the grooved posts and the antenna elements.

8. The method of claim 7, wherein the heavy metal plate includes heavy plate holes coincident with a top of each of the grooved posts and wherein the heavy plate holes contain solder that flows down onto the top of each of the grooved posts during heating of the radar array assembly.

9. The method of claim 5, further comprising, after heating the radar array assembly, applying additional solder to the grooved posts to supplement the first conductive joints, the second conductive joints, and the third conductive joints.

10. A method for fabricating a millimeter wave radar array assembly, comprising the steps of:

(a) providing a ground plane mounting plate;

(b) drilling staggered first cylindrical mounting holes spaced for receiving posts for holding discrete antenna elements and second cylindrical mounting holes spaced for receiving connector sections of the discrete antenna elements in the ground plane mounting plate, wherein the center-to-center spacing between the first cylindrical mounting holes is less than 1.0 cm;

(c) disposing a plurality of posts, each having a body portion including longitudinal grooves, and an elongate shaft portion having a smaller cross-section than the body portion of the post and sized to closely fit within the first mounting holes without use of a fastener and extending from a lower end of the body portion, onto the ground plane mounting plate by inserting a closed end of the shaft portion of each post into a corresponding one of the first cylindrical mounting holes so that the lower end of the body portion is disposed on the ground plane mounting plate; and (d) installing a plurality of the discrete antenna elements, each discrete antenna element being physically separate from each other discrete antenna element and including a single panel section having a single radiating horn element and a single cylindrical antenna base section electrically coupled to the single radiating horn element, by disposing the single panel section of each discrete antenna element within the longitudinal grooves of adjacent posts and disposing the corresponding cylindrical antenna base section of the discrete antenna elements within one of the second cylindrical mounting holes.

11. The method of claim 10, wherein drilling comprises counterbore drilling the first cylindrical mounting holes and the second cylindrical mounting holes in the ground plane mounting plate.

12. The method of claim 10, further comprising rotating the posts so that the longitudinal grooves of adjacent posts are aligned to receive panel sections of one of the antenna elements.

13. The method of claim 10, further comprising pre-tinning portions of the ground plane mounting plate and the posts with a metal.

14. The method of claim 13, further comprising heating the radar array assembly to reflow the metal, thereby forming first conductive joints between the posts and the first mounting holes, second conductive joints between the cylindrical antenna base sections and the second cylindrical mounting holes, and third conductive joints between the posts and ends of the panel sections of the antenna elements.

15. The method of claim 14, further comprising, before heating the radar array assembly, providing additional solder to the millimeter radar array assembly for reflow on the first conductive joints, the second conductive joints, or the third conductive joints.

16. The method of claim 14, further comprising, before heating the radar array assembly to reflow the metal, disposing a heavy metal plate on top of the posts and on top of the antenna elements, thereby applying pressure to the top of each of the posts and to the top of each of the antenna elements to ensure proper seating of each of the posts and the antenna elements.

17. The method of claim 16, wherein the heavy metal plate includes heavy plate holes coincident with a top of each of the posts and wherein the heavy plate holes contain solder that flows down onto the top of each of the posts during heating of the millimeter radar array assembly.

18. The method of claim 14, further comprising, after heating the radar array assembly, applying additional solder to the posts to supplement the first conductive joints, the second conductive joints, or the third conductive joints.

19. A millimeter wave radar array assembly comprising:

a ground plane mounting plate including first mounting holes spaced for receiving grooved posts for holding a panel section of a discrete antenna element and second mounting holes spaced for receiving a connector section of the discrete antenna element, at least some of the second mounting holes being between the first mounting holes, wherein the center-to-center spacing between the first mounting holes is less than 1.0 cm;

a plurality of grooved posts, each of the grooved posts comprising a first section having longitudinal grooves on each side, and an elongate shaft section extending from a lower end of the body portion, wherein the shaft section of each of the plurality of grooved posts has a closed end configured to be received into a corresponding one of the first mounting holes, wherein the elongate shaft section has a smaller cross-section than the first section of the grooved post and wherein the elongate shaft section is sized to closely fit within the first mounting holes without use of a fastener; and a plurality of the discrete antenna elements, each discrete antenna element having a single panel section including a single radiating horn element and a single cylindrical connector base electrically coupled to the single radiating horn element, wherein opposite edges of the panel section of each discrete antenna element are affixed within the grooves of adjacent installed grooved posts and the corresponding cylindrical connector base of the discrete antenna element is affixed within one of the second mounting holes.

20. The radar array assembly of claim 19, wherein the ground plane mounting plate comprises a gold plated copper plate with tin-lead plating on areas between the first mounting holes and the second mounting holes.

21. The radar array assembly of claim 19, wherein the grooved posts comprise tin-lead plating over gold over beryllium copper.

22. The radar array assembly of claim 19, wherein each panel section comprises a dielectric board defining a conductive horn and a stripline feed structure, said stripline feed structure being electrically connected to the conductive horn and the cylindrical connector base of each panel section.

23. The radar array assembly of claim 19, wherein the elongate shaft section of the grooved posts are affixed to the first mounting holes with a metal, the edge of the panel section of each of the antenna elements is affixed within the grooves of adjacent installed grooved posts with the metal, and the cylindrical connector base of each of the antenna elements are affixed to the second mounting holes with the metal.

24. The radar array assembly of claim 23, wherein the metal is one of a group consisting of solder and iridium.

25. An antenna element mounting post for a millimeter wave antenna array comprising:

an upper section having lengthwise grooves sized to accept an edge of a discrete antenna element panel having a single radiating horn element and a single connector section;

an elongate lower shaft section extending from a lower end of the upper section wherein the elongate lower shaft section has a closed end and is sized to closely fit within a ground plane mounting plate hole without use of a fastener, wherein the elongate lower shaft section has a smaller cross-section than the upper section.

26. The antenna element mounting post of claim 25, wherein the upper section has four sides and wherein one of the lengthwise grooves is centered on each of the four sides.

27. The antenna element mounting post of claim 25, wherein the elongate lower shaft section is cylindrical.

28. The antenna element mounting post of claim 25, wherein the antenna element mounting post is comprised of tin-lead plating over gold over beryllium copper.

* * * * *